US006405470B1

(12) United States Patent
Strahan

(10) Patent No.: US 6,405,470 B1
(45) Date of Patent: Jun. 18, 2002

(54) FIREARM SAFETY LOCK

(76) Inventor: Travis R. Strahan, 187 Townsend Cir., Ringold, GA (US) 30736

( * ) Notice: Subject to any disclaimer, the term of this patent is extended or adjusted under 35 U.S.C. 154(b) by 0 days.

(21) Appl. No.: 09/593,431

(22) Filed: Jun. 14, 2000

(51) Int. Cl.[7] ..... F41A 17/00
(52) U.S. Cl. ..... 42/70.08; 42/70.01; 42/70.11
(58) Field of Search ..... 42/70.08, 70.01, 42/70.02

(56) References Cited

U.S. PATENT DOCUMENTS

| | | | | |
|---|---|---|---|---|
| 2,945,316 | A | | 7/1960 | Mulno |
| 3,352,047 | A | * | 11/1967 | McDonnell |
| 3,673,725 | A | | 7/1972 | Cravener |
| 3,750,319 | A | | 8/1973 | Roy |
| 3,830,002 | A | | 8/1974 | Volkmar |
| 3,882,622 | A | * | 5/1975 | Perlotto |
| 3,979,850 | A | | 9/1976 | Schiessl et al. |
| 4,021,955 | A | * | 5/1977 | Curtis |
| 4,090,316 | A | * | 5/1978 | Volkmar |
| 4,313,274 | A | * | 2/1982 | Ludwig et al. |
| 4,555,861 | A | | 12/1985 | Khoury |
| 4,658,529 | A | * | 4/1987 | Bertolini |
| 4,726,136 | A | * | 2/1988 | Dornaus et al. |
| 4,843,748 | A | | 7/1989 | Tuma |
| 5,438,784 | A | | 8/1995 | Lenkarski et al. |
| 5,467,550 | A | * | 11/1995 | Mumbleau |
| 5,490,343 | A | * | 2/1996 | Cory et al. |
| 5,910,003 | A | * | 6/1999 | Kleinpaul |
| 6,212,991 | B1 | * | 4/2001 | Frazier, III |
| 6,240,670 | B1 | * | 6/2001 | Findlay |
| 6,259,918 | B1 | * | 7/2001 | Szabo |
| 6,260,298 | B1 | * | 7/2001 | Bubits |

FOREIGN PATENT DOCUMENTS

| | | | |
|---|---|---|---|
| DE | 0692741 | * | 6/1940 |
| GB | 0617133 | * | 2/1949 |
| GB | 660046 | * | 10/1951 |

* cited by examiner

*Primary Examiner*—Michael J. Carone
*Assistant Examiner*—Troy Chambers
(74) *Attorney, Agent, or Firm*—Rodgers & Rodgers

(57) ABSTRACT

A firearm safety lock including a firearm slide with a bore formed therein, a firing pin disposed in the bore, an aperture formed in the slide, a locking element formed on the firing pin and being disposed adjacent the aperture, a locking pin adaptable for insertion into the aperture where inward movement thereof causes it to come into contact with the locking element thereby restricting movement of the firing pin.

9 Claims, 3 Drawing Sheets

FIREARM SAFETY LOCK

BACKGROUND OF THE INVENTION

This invention relates to firearms and more particularly to a safety lock. Due to the widespread use of firearms, there is a constant need to develop improved safety mechanisms to prevent accidental firing of a firearm. Various devices have been utilized in the past such as conventional trigger locks or other mechanisms which completely lock and immobilize the firearm. Others provide only a partial lock which means the firearm is susceptible to accidental firing.

SUMMARY OF THE INVENTION

A firearm safety lock including means to immobilize the firearm firing pin and isolate it from contact with the firearm hammer and cartridge including a threaded aperture formed in the firearm slide, the firing pin disposed in a bore formed in the slide, a cutout element formed on the firing pin and disposed in proximity to the threaded aperture, and a threaded locking pin manually movable within the threaded aperture such that when the locking pin moves inwardly of the slide contact thereof with the cutout element causes the firing pin to move away from the hammer.

In a modified form of the invention, the threaded locking pin is maneuvered toward the firing pin and into an overlapping relationship with a shoulder formed on the firing pin to prevent forward movement thereof.

DETAILED DESCRIPTION OF THE PREFERRED EMBODIMENTS

Figure 1:
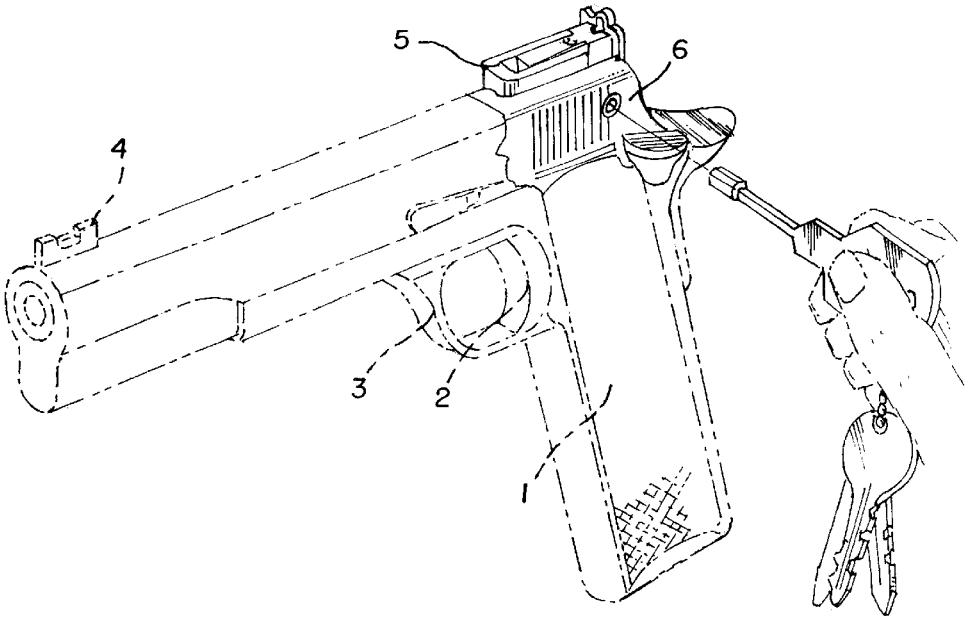
FIG. 1 is a perspective view of a firearm showing the safety lock according to this invention.
Figure 2:
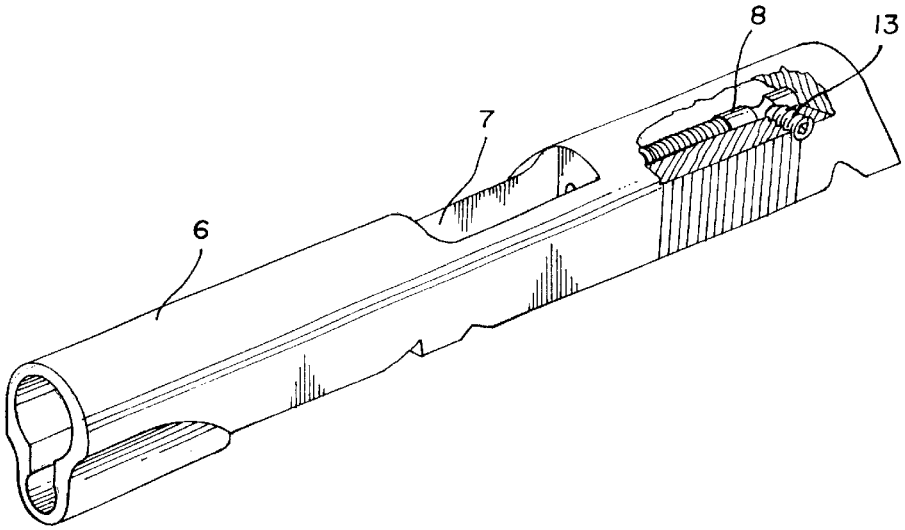
FIG. 2 is a perspective view of the slide element of the firearm.
Figure 3:
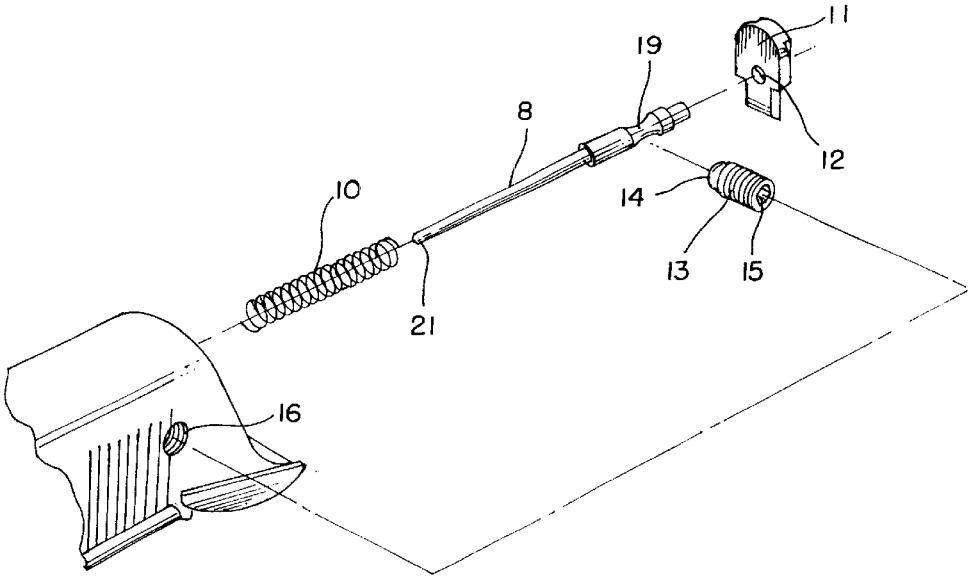
FIG. 3 is an exploded view showing the firing pin and safety lock.

In the drawings and with particular reference to FIG. 1, a conventional firearm is depicted including the basic elements of grip 1, trigger 2, trigger guard 3, front sight 4 and rear sight 5. With particular reference to FIG. 2, firearm slide 6 is shown having ejection slot 7 formed therein.

Figure 4:
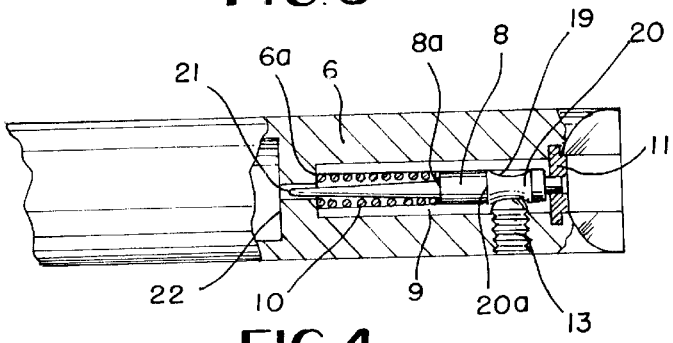
FIG. 4 is a top plan view of the safety lock in the locked position.

As is well known, firing pin 8 is disposed in bore 9 formed in slide 6. For the purpose of urging firing pin 8 rearwardly, spring 10 is provided, one end of which abuts against surface 6*a* of slide 6 and the other end of which abuts against surface 8*a* of firing pin 8, as best shown in FIG. 4. To complete the basic elements of the firearm, firing pin stop 11 is provided with aperture 12 formed therein.

Figure 5:
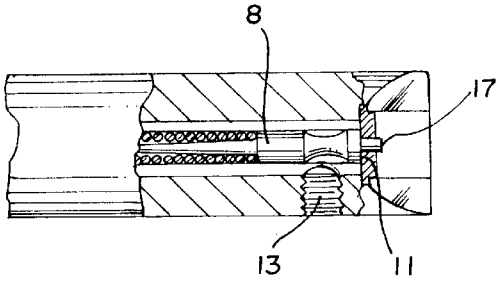
FIG. 5 is a top plan view of the safety lock in an unlocked condition.
Figure 6:
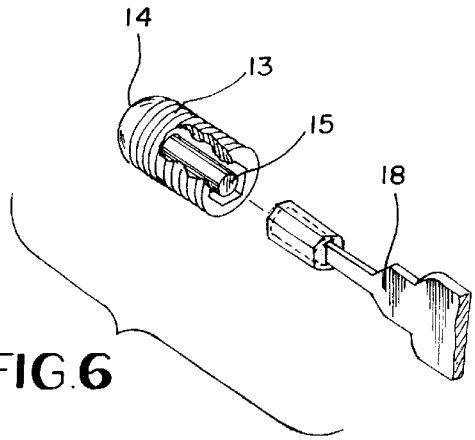
FIG. 6 is an exploded view of the safety lock manipulation means.

According to this invention, threaded locking pin 13 is provided and includes rounded tip 14 and manipulation detent 15. Locking pin 13 is adapted for insertion into internally threaded locking aperture 16 formed in slide 6. In FIG. 5, firing pin 8 is shown in the firing position wherein proximate end 17 of firing pin 8 extends through aperture 12 and beyond the hammer receiving surface of firing pin stop 11.

In order to lock firing pin 8, according to this invention, it is necessary to turn locking pin 13, disposed in aperture 16, in a clockwise manner such as by means of a mechanical cooperation between manipulation instrument 18 and manipulation detent 15 such that locking pin 13 is moved toward the interior of slide 6 from the position essentially shown in FIG. 5 to the position shown in FIG. 4. By this means, rounded tip 14 slides along inwardly extending distal surface 19 of cutout or hourglass-shaped element 20 of firing pin 8. The distal surface 19 of cutout element 20 extends between the distal end 20*a* of cutout element 20 and the middle thereof wherein the diameter of cutout element 20 is the smallest.

As locking pin 13 slides along surface 19, firing pin 8 is caused to move toward the distal end of the firearm to a position wherein the axis of locking pin 13 is approximately in alignment with the middle of cutout element 20. In this position, proximate end 17 of firing pin 8 is disposed within aperture 12 thereby eliminating any possibility of the firearm hammer striking firing pin 8. In addition, distal end 21 of firing pin 8 is disposed within bore 9 such that it does not extend beyond recoil surface 22 of slide 6. By this means, firing pin 8 is completely isolated such that contact thereof is prevented with either the firearm hammer or the cartridge.

Figure 7:
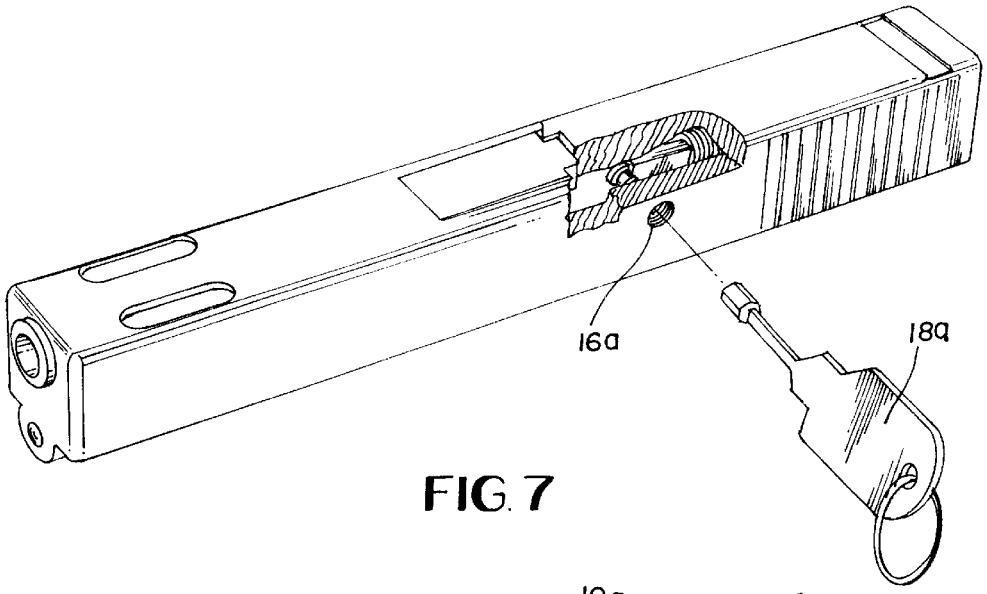
FIG. 7 is a perspective view similar to FIG. 2 showing a modified form of the invention.
Figure 8:
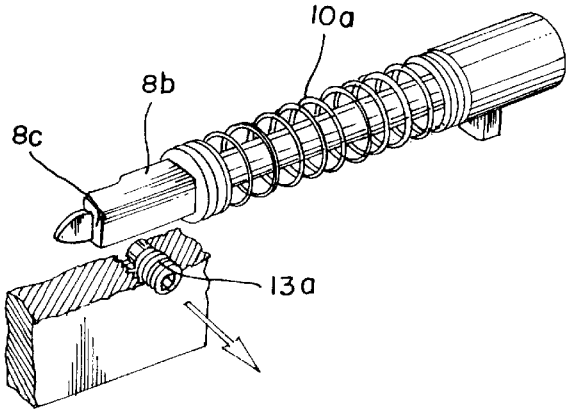
FIG. 8 is a perspective view of the modification in an unlocked condition.
Figure 9:
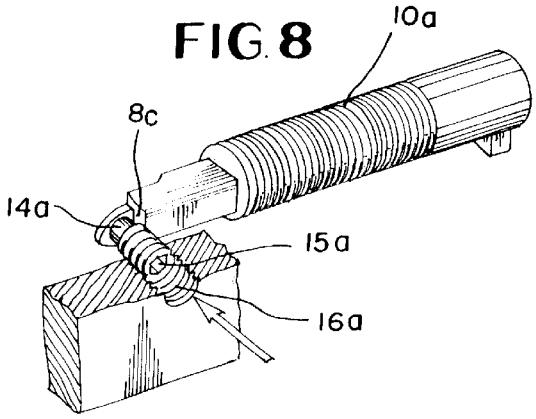
FIG. 9 is a perspective view of the modification in the locked position.

A modification of this invention is shown in FIGS. 7, 8 and 9 wherein firing pin 8*b* embodies a somewhat different configuration than firing pin 8, as shown in FIGS. 1–6. More specifically, firing pin 8*b* is provided with shoulder 8*c*. In order to lock firing pin 8*b*, it is retracted in a conventional manner thereby compressing spring 10*a*, as shown in FIG. 9. Then, locking pin 13*a* is screwed clockwise through threaded aperture in such manner that tip 14*a* is maneuvered into abutting overlapping relationship with shoulder 8*c* thereby preventing forward movement of firing pin 8*b*.

In order to unlock the mechanism shown in FIGS. 1–6, it is simply necessary to insert manipulation instrument 18 into manipulation detent 15 and turn instrument 18 counterclockwise. In FIGS. 7–9, manipulation instrument 18*a* is inserted into manipulation detent 15*a* and operated in the same manner. Also, the manipulation instrument and manipulation detent are manufactured of nonstandard dimensions so that the safety lock cannot be circumvented using standard tools.

Therefore, by this invention, the firearm trigger can be manipulated either accidentally or intentionally without firing the weapon. Also, the firearm cannot be fired accidentally even if handled carelessly such as being dropped and the like but still can be fully disassembled and reassembled, as desired, and can be loaded and unloaded with absolute safety.

What is claimed is:

1. A firearm safety lock comprising a slide, a bore formed in said slide, a firing pin disposed in said bore, a cutout element formed on said firing pin, an internally threaded aperture formed in said slide in proximity to said cutout element, a locking pin adapted for insertion into said aperture, said locking pin having an interior end and an exterior end, said cutout element comprising a distal end and a proximate end, the middle of said cutout element being disposed between said proximate and distal ends, the surface of said cutout element between said distal end and said middle extending inwardly of said firing pin, the axis of said locking pin being initially in alignment generally with said surface such that as said locking pin is manipulated inwardly said interior end is caused to slide along said surface toward said middle.

2. A firearm safety lock according to claim 1 wherein a manipulation detent is formed in said exterior end.

3. A firearm safety lock according to claim 2 wherein a manipulation instrument is adapted to cooperate with said detent to turn said locking pin.

4. A firearm safety lock according to claim 3 wherein said detent and said instrument are of irregular configuration.

5. A firearm safety lock according to claim 1 wherein said cutout element extends around the periphery of said firing pin.

6. A firearm safety lock according to claim 1 wherein said internal end is dome-shaped.

7. A firearm safety lock according to claim 1 wherein a surface is disposed at one end of said bore and a firing pin stop is disposed at the opposite end of said bore.

8. A firearm safety lock according to claim 7 wherein an aperture is formed in said firing pin stop.

9. A firearm safety lock according to claim 8 wherein said firing pin at one end is disposed in said bore and at the other end is disposed in said aperture formed in said firing pin stop.

* * * * *